US006615411B2

(12) United States Patent
Johnson

(10) Patent No.: US 6,615,411 B2
(45) Date of Patent: Sep. 9, 2003

(54) TOILET SEAT SANITARY PROTECTOR CHANGER

(76) Inventor: Charles W. Johnson, 33 Ketewomoke Dr., Huntington, NY (US) 11743

( * ) Notice: Subject to any disclaimer, the term of this patent is extended or adjusted under 35 U.S.C. 154(b) by 0 days.

(21) Appl. No.: 09/952,889

(22) Filed: Sep. 15, 2001

(65) Prior Publication Data

US 2002/0088049 A1 Jul. 11, 2002

Related U.S. Application Data

(63) Continuation of application No. 09/628,175, filed as application No. PCT/US99/01633 on Jan. 27, 1999, now abandoned.

(60) Provisional application No. 60/072,821, filed on Jan. 28, 1998.

(51) Int. Cl.[7] ..... A47K 13/18

(52) U.S. Cl. ..... 4/243.3

(58) Field of Search ..... 4/243.3

(56) References Cited

U.S. PATENT DOCUMENTS 2,175,553 A * 10/1939 Altiery ..... 4/243.3
4,769,859 A * 9/1988 Bobak ..... 4/243.3

* cited by examiner

*Primary Examiner*—Robert M. Fetsuga
(74) *Attorney, Agent, or Firm*—Dilworth & Barrese, LLP

(57) ABSTRACT

There is provided a toilet seat sanitary protector changer which may be provided in new public rest facilities or retrofitted to existing facilities. The changer generally includes a seat having a supply assembly positioned on one side and a takeup assembly provided on the opposite side. The seat includes mounting structure for movably mounting the seat to an existing toilet bowl. The changer is configured to receive a supply of a continuous strip of sanitary protective covers in supply assembly and feed the covers across the seat to the takeup assembly. The takeup assembly includes a slotted takeup rod configured to receive a leading end of the strip of covers and a prestressed constant torque spring motor affixed relative to the takeup rod so as to rotate the takeup rod a predetermined number of times. A multiplier gear may be provided to increase the number of turns of the takeup rod relative to the number of turns of the spring motor. The supply assembly includes a braking mechanism which is configured to tension the strip of protectors across the seat and a sensor which is engageable with apertures in the protective covers so as to halt advancement of the cover as an aperture of the cover overlies the opening of the toilet seat. A release mechanism or pushbutton may be provided to override the brake mechanism. The seat takeup assembly and supply assembly are provided as a single unit which is movable from a position adjacent the toilet seat to a position spaced apart from the toilet seat.

16 Claims, 2 Drawing Sheets

TOILET SEAT SANITARY PROTECTOR CHANGER

CROSS-REFERENCE TO RELATED APPLICATIONS

This application is a continuation of U.S. patent application Ser. No. 09/628,175 filed on Jul. 28, 2000 now abandoned as U.S. National Stage Continuation application of International Application No. PCT/US99/01633 filed on Jan. 27, 1999, and which, in turn, is based upon and claims priority to U.S. Provisional Application Serial No. 60/072,821, filed Jan. 28, 1998. and entitled "Toilet Seat Sanitary Protector Changer".

BACKGROUND

1. Field of the Invention

The present invention relates to a retrofittable toilet seat sanitary protector changer for use with a conventional toilet bowl, and, more particularly, to a toilet seat sanitary protector changer utilizing a prestressed continuous torque spring motor for providing constant tension on a continuous strip of sanitary toilet seat protectors.

2. Description of the Related Art

The fear of disease or disgust from contact with dirty or soiled public toilet seats is well known. The risk of disease and other unpleasant experiences is most common when utilizing toilets in public facilities, such as office buildings, and in remote areas like parks or camping facilities. Various attempts have been made to protect users from coming into contact with contaminated seats. One simple method is to utilize strips of toilet paper which are placed on the seat during use. This is in itself awkward and unsanitary.

More recently, individual sanitary protectors or covers in the shape of the toilet ring have been supplied in dispensers affixed to the wall of a booth. While relatively easy to position the cover over the seat, these covers are subject to slippage. Additionally, the covers are often flushed down the toilet after use. Since the covers are typically formed of a relatively tough, protective, sanitary material, they are prone to clogging the system.

In some instances, sanitary toilet seat covers have been provided as a continuous strip of covers interspersed with openings configured to approximate the opening of the toilet seat bowl and wound upon a roll. One particular disclosure of a dispenser for such covers is in U.S. Pat. No. 2,175,553 to Altiery. The Altiery device uses an enlarged metal cabinet with a hole at its top. The cabinet is configured to be positioned entirely over the existing toilet bowl. A first supply spool is affixed within the cabinet and contains a continuous strip of toilet seat protective covers which are extended over the existing toilet seat and are taken up on a second spool also affixed within the cabinet. The Altiery device includes a spring motor having a coil spring positioned therein and attached to the rear wall of the cabinet for driving the second or takeup spool.

While the Altiery device provides the advantages of having a continuous strip of protective covers extending out of one supply and across the seat and into a second supply, the Altiery device does have numerous disadvantages. By utilizing a coil-type spring, which inherently decreases in torque or tensioning force as it is unwound, the amount of torque or tension to pull the toilet seat covers across the toilet seat rapidly decreases thereby limiting the length of the strip and amount of toilet seat covers that may be provided within the unit. This is of particular disadvantage when the unit is used in remote areas such as public camping facilities wherein daily maintenance to replace the covers is not routine.

Additionally, the size and shape of the metal cabinet, which must completely surround the existing toilet bowl, drastically limits the number of units that may be accommodated in any particular area. Furthermore, by affixing the supply and takeup spools to a metal cabinet which is placed about the toilet bowl such that the strip of protectors runs over the toilet seat, it is impossible to raise the toilet seat for the use and convenience of male users without tearing or interrupting the continuous strip of covers.

Therefore, there exists a need for a convenient retrofittable toilet seat sanitary protective changer which may be powered by a source having sufficient energy to provide tension on a relatively long strip of covers for an extended period of time and number of revolutions of a spool.

Furthermore, there exists a need for a compact toilet seat protective cover changer which may be easily retrofitted to an existing toilet bowl and which may be raised up as an entire unit for the convenience of male users so as to avoid the disruption of the continuous strip of protective covers.

SUMMARY

There is disclosed a toilet seat sanitary protector changer for use with an existing toilet bowl. The changer generally includes a toilet seat having a supply assembly positioned on one side and takeup assembly positioned on the opposite side. The supply assembly generally includes a housing affixed to or integral with the seat. The housing is configured to receive a roll of a continuous strip of protective covers wound about a core. The takeup assembly also includes a housing affixed to or integral with the toilet seat and further includes an elongated takeup rod rotatably mounted within the housing and having a slot for receipt of a leading edge of the strip of protective covers.

A prestressed spring motor is provided for engagement with the takeup rod so as to provide a constant or substantially constant torque on the takeup rod over a predetermined number of turns of the rod. Preferably, a multiplier gear is interspersed between the spring motor and the takeup rod so as to multiply the number of turns of the takeup rod relative to the spring motor. Preferably, approximately 15 to 50 turns of the spring motor will result in 400–500 turns of the takeup rod.

The supply assembly preferably includes a braking mechanism for restraining rotation of the roll of protective covers within the supply assembly. Alternatively, the braking mechanism may be located on the takeup side or other location so long as it is activated when the protective covers are properly indexed over the seat. The braking mechanism generally includes a brake which is engageable with an end of the roll or the core and a sensor finger which, in conjunction with apertures in the sheet of protective covers, engages the brake with the roll when an aperture in the sheet is properly positioned over the opening in the toilet seat. A pushbutton or release mechanism is provided to override the brake and allow the user to advance the roll of protective covers so as to provide a fresh cover for the next user.

The toilet seat may be formed as a continuous ring. In a preferred embodiment, the toilet seat may be formed as a discontinuous ring with an opening in the forward end so as to comply with various health codes. The seat is provided with a hinge assembly having a pair of mounting holes for movably mounting the seat to an existing toilet bowl. This toilet seat, supply assembly and takeup assembly, as an entire unit, may be moved from a position adjacent the toilet bowl to a position spaced apart from the toilet bowl to facilitate use by male users.

Further, the supply and takeup assemblies may be separately fitted to an existing toilet bowl seat.

DETAILED DESCRIPTION OF PREFERRED EMBODIMENTS

Figure 1:
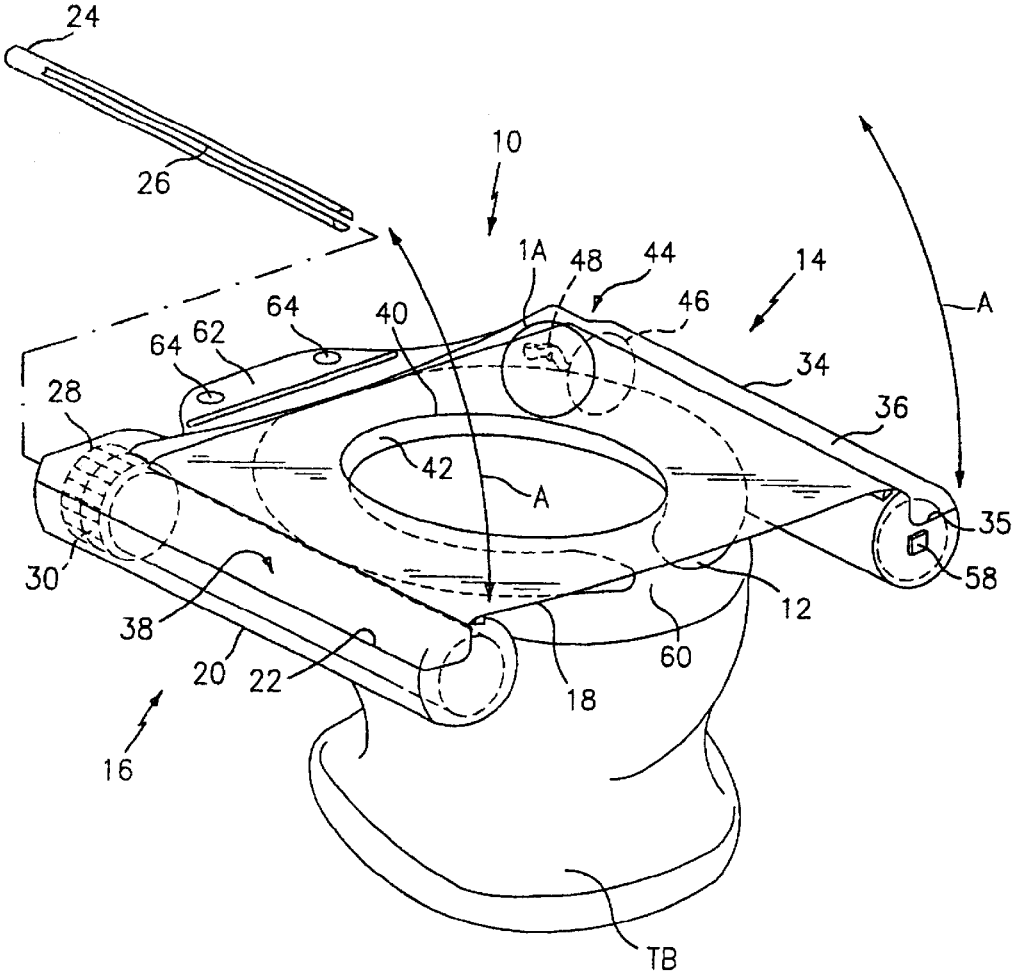
FIG. 1 is a perspective view of a preferred embodiment of a toilet seat sanitary changer protector for use in conjunction with a conventional toilet.

Referring to FIG. 1, there is disclosed a toilet seat sanitary protector changer or changer 10 for use with a conventional toilet bowl TB. Changer 10 may include a seat 12 having a supply assembly 14 positioned on one side thereof and takeup assembly 16 positioned on an opposite side thereof. While the embodiment illustrated shows the supply assembly on the right side of the seat and the takeup assembly on the left side of the seat, when facing the seat, it is obviously contemplated that these positions may be reversed. Seat 12 may be formed of injection molded plastic. It is also contemplated that changer 10 can be configured to mount over an existing seat. Takeup assembly 16 is configured to draw a continuous strip of toilet seat sanitary protectors such as strip 18 out of supply assembly 14 and into takeup assembly 16. Takeup assembly 16 generally includes an outer housing 20 defining a chamber 22 therein. A takeup rod 24 having an elongated slot 26 is provided within housing 20 for receipt of a leading end of strip 18. As shown, elongated slot 26 in takeup rod 24 extends through one end thereof to facilitate removal of a roll of soiled protectors. Alternatively, a removable core may be provided in place of takeup rod 24.

In order to supply substantially constant and, more importantly, consistent tension on strip 18 as it is drawn out of supply assembly 14 and into takeup assembly 16, takeup assembly 16 includes a prestressed spring motor 28. Spring motor 28 is of the type designed to maintain relatively constant force output over a predetermined number of working turns. An appropriate spring motor is, for example, a Contorque Spring Motor available from Vulcan Spring in Pennsylvania. Spring motor 28 is connected to takeup rod 24 so as to provide a constant torque on takeup rod 24. Preferably, spring motor 28 is connected to takeup rod 24 through a gear train or multiplier gear 30 such that a single winding or turn of spring motor 28 will result in multiple turns of takeup rod 24. By utilizing a prestressed spring motor to power the changer, electrical shock hazards can be eliminated and the changer may be easily used in remote areas where electrical power is unavailable. Preferably, multiplier gear 30 converts approximately 15–50 full windings of spring motor 28 into approximately 400–500 turns of takeup rod 24.

Figure 2:
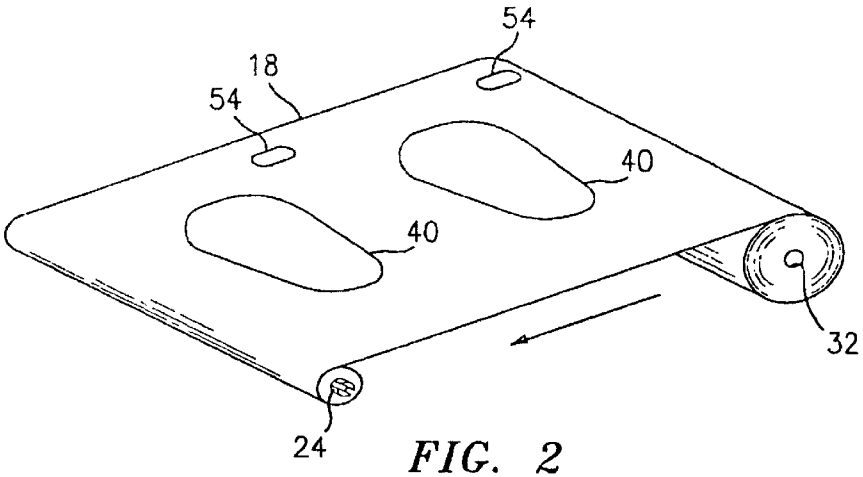
FIG. 2 is a perspective view of a continuous strip of sanitary seat covers.

Referring for the moment to FIG. 2, strip 18 is preferably provided as a continuous roll of seat protectors wound about an inner core 32. Core 32 may be formed from any suitable material, such as, for example, cardboard or plastic. By providing strip 18 on a core 32 simple "drop-in" loading of changer 10 is attained.

Referring back to FIG. 1, supply assembly 14 generally includes a housing 34 defining a chamber 35 therein for receipt of strip 18 rolled about core 32. Housings 20 and 34 may be affixed to seat 12 or formed integrally therewith. Strip 18 exits housing 34 through an opening 36 and extends across seat 12 to an opening 38 in takeup housing 20. Continuous strip of seat protective covers 18 generally include a plurality of spaced first apertures 40 which correspond to an aperture 42 defined by seat 12. Preferably, first apertures 40 are slightly smaller in diameter than seat aperture 42.

Figure 1A:
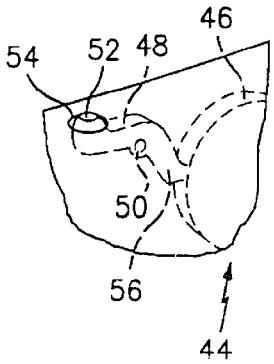
FIG. 1A is an enlarged area of detail view of the braking mechanism of FIG. 1.

In order to retain opening 40 of strip 18 in alignment with opening 42 of seat 12, supply assembly 14 is provided with a braking mechanism 44 which provides a braking force against the tension of spring motor 28. Referring to FIGS. 1 and 1A, braking mechanism 44 is provided with a brake 46 which is configured to frictionally engage an end of core 32 of strip 18 in its rolled configuration. Braking mechanism 44 provides a stabilizing tension on strip 18 against the tension applied by spring motor 28. Braking may be by end friction or by use of a spindle or fluted shaft in core 32.

Braking mechanism 44 further includes a sensor finger 48 which is provided to detect correct alignment of opening 40 with opening 42. As best illustrated in FIG. 1A, sensor finger 48 is preferably formed in a dog leg shape and pivots about a point 50. Sensor finger 48 includes a sensor tip 52 which is configured to detect a second aperture 54 provided in spaced locations along strip 18. Second aperture 54 is positioned on strip 18 at a predetermined distance relative to aperture 42. An opposite end 56 of sensor finger 48 actuates brake 46. Preferably, sensor finger 48 is designed such that sensor tip 52 is biased upwardly towards an underside of strip 18. Upon engagement of sensor tip 52 within second aperture 54 of strip 18, brake 46 is actuated to halt advancement of strip 18 across seat 12 thereby aligning first aperture 42 of strip 18 with aperture 42 of seat 12. It is within the contemplated scope of the present invention that sensor finger 48 need not be limited to a dog leg shape but, rather, may include other shapes as well as other structure, such as, for example, sliding rods, cam levers, etc. An actuator or push button 58 (FIG. 1) is provided at a forward edge of housing 34 and is operably engageable with brake 46 so as to manually override or release brake 46 in order to advance strip 18 across seat 12. It is envisioned that other braking mechanisms may be used and further that the braking mechanism may be located separate from the supply assembly so long as an appropriate braking force is applied against the tension of spring motor 28. Additionally, other forms of actuators, such as, for example, foot pads etc. may be provided and may be located remote from seat 12.

As noted hereinabove, toilet seat sanitary protector changer 10 including supply assembly 14 and takeup assembly 16 is provided to continuously and intermittently advance a strip of seat protectors across seat 12. When seat 12 is provided as an integral part of changer 10, seat 12 may be of a continuous circular variety or may include an opening 60 provided at the front as may be required by various health codes. Importantly, changer 10 is configured to be used with a conventional toilet bowl TB and/or seat such as that found in public rest facilities, for example, those found in office buildings, parks, etc. In order to conveniently and easily retrofit changer 10 to an existing toilet bowl TB a hinge plate 62 is provided at a back end of seat 12. Hinge plate 62 includes mounting holes 64 for receipt of mounting bolts. The mounting bolts may be utilized from a prior seat or may be included as part of changer 10. Installation is easily accomplished by removal of two bolts and the old seat and replacement with changer 10.

Referring to FIGS. 1 and 2, in operation, continuous strip of protector covers 18 wound about core 32 is initially positioned within supply assembly 14 in chamber 35. A leading edge of strip 18 is drawn across seat 12 and inserted through opening 38 in housing 20 and into slot 26 of takeup rod 24. An initial length of strip 18 may be devoid of openings in order to allow a sufficient amount of strip 18 to be wound around takeup rod 24. Prestressed spring motor 28 may be wound up by utilizing an external hand crank or drill or any other conventional known method of winding a prestressed spring motor. Strip 18 is either moved across seat 12 manually or by operation of spring motor 28 so as to align second aperture 54 with sensor tip 52. Once sensor tip 52 engages second aperture 54, brake 46 engages core 32 thereby arresting further movement of strip 18 across seat 12. As noted hereinabove, in this position first aperture 40 of strip 18 is in alignment with aperture 42 of seat 12. As noted above, aperture 40 is slightly smaller in diameter than aperture 42 to ensure sanitary covering of seat 12.

After use, push-button 58 is depressed to momentarily disengage brake 46 from core 32. Spring motor 28, through multiplier gear 30, rotates takeup rod 24 with a constant and consistent torque to draw strip 18 across toilet seat 12 so as to provide a fresh clean sanitary protector for a next user. A centrifugal or friction type speed governor may be incorporated into supply assembly 14 so as to avoid any "free-wheel" effect of core 32 as it unwinds. As strip 18 is being drawn across toilet seat 12 sensor finger 48 and a particular sensor tip 52 ride on an underside edge of strip 18 until such time as sensor tip 52 engages a next adjacent second aperture 54. Upon engagement with second aperture 54, sensor finger 48 reengages brake 46 to again arrest or brake movement of strip 18 across seat 12. This procedure can be repeatedly performed, preferably approximately 100 times, until the entire strip 18 is used up.

Notably, should strip 18 break or tear at any point inbetween, the soiled material of strip 18 may be removed from takeup rod 24 and the torn clean end of strip 18 inserted in slot 26 in takeup rod 24 so as to easily continue operation and avoid wasting a damaged roll.

It should be noted that one particular novel aspect of this embodiment of the present invention is that seat 12 along with supply assembly 14 and takeup assembly 16 are configured as a unitary structure which are affixed to conventional toilet bowl TB by means of hinge 62. Thus, when desired by male users, the entire toilet seat sanitary protector changer 10 may be raised or lowered in the direction of arrows A without interrupting or tearing strip 18. Additionally, as noted hereinabove, this unique structure may be quickly and readily retrofitted to any existing conventional toilet bowl thus providing significant and inexpensive adaptation and maintenance advantages for public restroom facilities.

Figure 3:
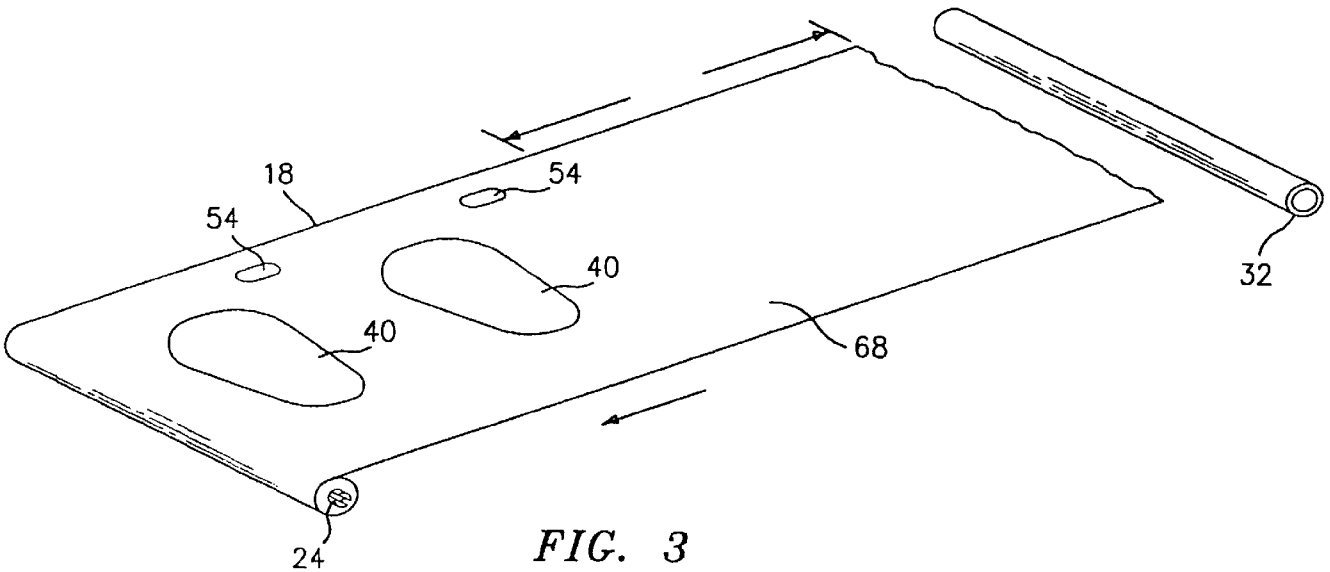
FIG. 3 is a perspective view of the continuous strip of sanitary seat covers illustrating the trailing end of the strip.

Referring now to FIG. 3, as continuous strip 18 is advanced across toilet seat 12 (FIG. 1) and wound about takeup rod 24 and off of core 32, it is preferred that a trailing end 68 of continuous strip 18 not include or be devoid of both first openings 40 and second openings 54 such that a significantly clean length of sanitary protector is wound about the roll of soiled protector. Takeup rod 24 may be removable from takeup assembly 16 such that the entire soiled strip 18 and takeup rod 24 may be disposed of. Alternatively, and preferably, takeup rod 24 is affixed within takeup assembly 16 such that rolled and used or soiled strip 18 may be removed from takeup rod 24 and disposed of in a sanitary manner.

It should be noted that openings 36 and opening 38 of supply assembly 14 and takeup assembly 16, respectively, further facilitate easy maintenance and cleaning of changer 10. Additionally, it is preferable that housings 20 and 34 include drain slots or holes in the undersides thereof to facilitate drainage of cleaning fluids.

It will be understood that various modifications may be made to the disclosed embodiment. For example, the seat may be omitted from the toilet seat sanitary protector changer when the changer, including the supply assembly and takeup assembly, are fitted to an existing seat, for example, by affixing each assembly to a side of the seat or to another structure, plate, bars, etc. which in turn are affixed to an underside of the seat. Further, the seat may be of the full or split ring variety depending upon local codes. Additionally, other breaking or tensioning mechanisms may be provided in the supply assembly. Thus, the above description should not be construed as limiting but merely as exemplification of a preferred embodiment. Those skilled in the art will envision other modifications within scope of the claims appended hereto.

What is claimed is:

1. A toilet seat sanitary cover changer for use with a conventional toilet bowl comprising:

a toilet seat defining an aperture therein;

a supply assembly on a first side of said toilet seat;

a takeup assembly on a second side of said toilet seat, said takeup assembly including a takeup rod having an elongated slot, and a prestressed spring motor operatively engageable with said takeut, rod, said prestressed spring motor connected to a multiplier gear between said motor and said takeup rod for converting a limited number of turns of said motor into a larger number of turns of said takeup rod and for providing a relatively constant torque to said takeup rod over a predetermined number of working turns of said takeup rod; and a roll of sanitary covers positionable in said supply assembly, an end of said roll of covers extendable over said aperture of said seat and insertable into said slot of said takeup rod said sanitary covers including a plurality of first apertures indexible to correspond to said aperture of said seat.

2. The toilet seat sanitary cover changer as recited in claim 1, wherein said supply assembly includes a core about which said roll of sanitary covers are wound and a braking mechanism engageable with said core.

3. The toilet seat sanitary cover changer as recited in claim 2, wherein said supply assembly further includes a sensor finger operably connected to said braking mechanism, said sensor finger configured to engage second apertures formed in said roll of sanitary covers such that when said finger is engaged with said second aperture of said roll of sanitary covers, said braking mechanism engages said core.

4. The toilet seat sanitary cover changer as recited in claim 3, further comprising an actuator operatively engaged with said braking mechanism such that operation of said actuator releases said braking mechanism from said core.

5. The toilet seat sanitary cover changer as recited in claim 1, wherein said seat includes a hinge for removably mounting said seat to a toilet bowl.

6. The toilet seat sanitary cover changer as recited in claim 1, wherein said multiplier gear assembly converts approximately 15 to 50 turns of said spring motor to approximately 400–500 turns of said takeup shaft rod.

7. A toilet seat sanitary cover changer for use with a toilet bowl comprising:

a toilet seat having a hinge for movably mounting said unitary seat to a toilet bowl;

a supply assembly in a first side of said toilet seat;

a takeup assembly located in a second side of said seat, said takeup assembly including a takeup rod and a prestressed spring motor operatively engageable with said takeup rod and connected to a multiplier gear, said multiplier gear being located between said motor and a rear end of said takeup rod for converting a limited number of turns of said motor into a larger number of turns of said takeup rod and for providing a relatively constant torque to said takeup rod over a predetermined number of working turns of said takeup rod and a roll of sanitary covers extending from said supply assembly to said takeup assembly, said toilet seat, said supply assembly and said takeup rod, said prestressed spring motor and said multiplier gear being movable from a first position adjacent to the toilet bowl to a second position spaced apart from the toilet bowl.

8. The toilet seat sanitary cover changer as recited in claim 7, wherein said supply assembly includes a supply housing formed integrally with said seat.

9. The toilet seat sanitary cover changer as recited in claim 7, wherein said supply assembly includes a supply housing affixed to said toilet seat.

10. The toilet seat sanitary cover changer as recited in claim 7, wherein said takeup assembly includes a takeup housing receiving said prestressed spring motor, said takeup rod and said multiplier gear and formed integrally with said toilet seat.

11. The toilet seat sanitary cover changer as recited in claim 7, wherein said takeup assembly includes a takeup housing receiving said prestressed spring motor, said takeup rod and said multiplier gear and affixed to said toilet seat.

12. The toilet seat sanitary cover changer as recited in claim 7, wherein said seat is formed with an opening at a forward end.

13. The toilet seat sanitary cover changer as recited in claim 7, wherein said supply assembly includes a braking mechanism engageable with a core of said roll of sanitary covers.

14. A toilet seat sanitary cover changer for use with a toilet bowl comprising:

a seat defining an aperture therein;

a hinge affixed to said seat for movably mounting said seat on a toilet bowl between a first position adjacent to the toilet bowl and a second position spaced apart from the toilet bowl;

a supply assembly affixed to and displaceable with said seat, said supply assembly including a housing for receipt of a continuous roll of sanitary toilet seat covers having a leading end and a braking mechanism releasably engageable with said roll of sanitary toilet seat covers;

a takeup assembly having a housing affixed to and displaceable with said seat, said takeup assembly including a takeup rod rotatably supported in said housing and having an elongated slot, which extends through a front end of said takeup rod and receives said leading end of said continuous roll of sanitary toilet seat covers and a prestressed spring motor engageable with said takeup rod and, connected to a multiplier gear between said motor and a rear end of said takeup rod for converting a limited number of turns of said motor into a larger number of turns of said takeup rod and for providing a relatively constant torque to said takeup rod over a predetermined number of working turns of said takeup rod, said spring motor operable to rotate said takeup rod such that upon engagement of said braking mechanism with the roll of sanitary toilet seat covers, said takeup rod tensions a section of said roll of sanitary toilet seat covers over said seat and upon disengagmenet of said braking mechanisms said spring motor turns said takeup rod to wind a section of said roll of sanitary toilet seat covers about said takeup rod, whereas said leading end of said continuous roll is continuously engaged into said slot of said takeup rod during engagement and disengagement of said braking mechanism.

15. The toilet seat sanitary cover changer as recited in claim 14, wherein said braking mechanism includes a sensor finger positionable within an aperture in the roll of sanitary toilet seat covers.

16. The toilet seat sanitary cover changer as recited in claim 15, wherein said braking mechanism includes an actuator to disengage said braking mechanism from the roll of sanitary toilet seat covers.

* * * * *